US009849714B2

(12) United States Patent
Lin

(10) Patent No.: US 9,849,714 B2
(45) Date of Patent: Dec. 26, 2017

(54) PLASTIC PLATE CLIP

(71) Applicant: Chunhai Lin, Guangdong (CN)

(72) Inventor: Chunhai Lin, Guangdong (CN)

(73) Assignee: Ming Fuk Leung, Hong Kong (CN)

( * ) Notice: Subject to any disclaimer, the term of this patent is extended or adjusted under 35 U.S.C. 154(b) by 0 days.

(21) Appl. No.: 14/438,325

(22) PCT Filed: Aug. 29, 2013

(86) PCT No.: PCT/CN2013/082545
§ 371 (c)(1),
(2) Date: Apr. 24, 2015

(87) PCT Pub. No.: WO2014/044115
PCT Pub. Date: Mar. 27, 2014

(65) Prior Publication Data

US 2015/0251482 A1 Sep. 10, 2015

(30) Foreign Application Priority Data

Sep. 18, 2012 (CN) ..... 2012 2 0475486 U

(51) Int. Cl.
*A44B 1/04* (2006.01)
*B42F 1/00* (2006.01)
*B42F 1/10* (2006.01)

(52) U.S. Cl.
CPC ..... *B42F 1/006* (2013.01); *B42F 1/10* (2013.01); *B42P 2241/10* (2013.01); *Y10T 24/202* (2015.01)

(58) Field of Classification Search
CPC ..... B42F 1/006; B42F 1/10; Y10T 24/202; B42P 2241/10
See application file for complete search history.

(56) References Cited

U.S. PATENT DOCUMENTS 491,011 A * 1/1893 Dom ..... B42F 9/001 24/67.7
2,317,204 A * 4/1943 Lowenthal ..... A47G 1/162 248/498

(Continued)

FOREIGN PATENT DOCUMENTS

CN 1475368 A * 2/2004

OTHER PUBLICATIONS

Zheng Hongru, CN1475368 A, File wire plate clamp and manufacturing method of its seat plate _ Google Translation, Feb. 18, 2004.*

*Primary Examiner* — Kimberly Wood
(74) *Attorney, Agent, or Firm* — Ming Chow; Sinorica, LLC

(57) ABSTRACT

A plastic plate clip comprises a bottom plate, a hook and a torsional spring. The hook comprises rotating shafts provided on two sides of the front end, connecting portions are provided on two sides of the middle part, and a fixed portion is provided at the rear end, the two ends of each of the connecting portions are connected to an end of the respective rotating shaft and one end of the fixed portion, respectively. The bottom plate is a plastic plate, and the front end of the plastic plate arches upward to form an arc-shaped groove into which the other end of the rotating shaft is inserted. The torsional spring is sleeved onto the rotating shaft, and one end of the torsional spring is riveted to the rotating shaft while the other end thereof detachably presses against the bottom plate.

8 Claims, 9 Drawing Sheets

(56) References Cited

U.S. PATENT DOCUMENTS 2,456,129 A * 12/1948 Krogh ..... G09F 1/10 224/558
2,696,962 A * 12/1954 Goss ..... A47G 1/215 248/201
2,996,775 A * 8/1961 Vernon ..... B42D 5/006 24/510
3,146,937 A * 9/1964 Vesak ..... B65D 5/46032 229/117.22
3,216,742 A * 11/1965 Strain ..... B42F 9/001 24/67 R
4,436,269 A * 3/1984 Dirksing ..... E03D 9/032 248/214
4,524,938 A * 6/1985 Strahs ..... A46B 17/04 248/110
4,628,572 A * 12/1986 Chang ..... B42F 1/00 24/67 R
4,763,389 A * 8/1988 Chang ..... B42F 1/006 24/67 R
4,948,172 A * 8/1990 Chang ..... B42F 9/001 281/30
4,961,249 A * 10/1990 Liu ..... B42F 9/001 24/500
4,974,798 A * 12/1990 Harding ..... H02G 3/26 174/72 A
5,035,389 A * 7/1991 Wang ..... A47G 29/08 248/224.51
5,058,242 A * 10/1991 Liu ..... B42F 9/001 24/67 R
5,509,528 A * 4/1996 Weisburn ..... B65D 25/22 206/308.1
5,924,790 A * 7/1999 Ponton ..... B60Q 1/2638 362/365
5,988,926 A * 11/1999 Kiyomi ..... B42F 13/0073 281/36
6,098,941 A * 8/2000 Gates ..... A47B 96/061 248/224.51
D487,579 S * 3/2004 Chen ..... D19/88
7,404,487 B2 * 7/2008 Kumakura ..... B65D 71/08 206/467
7,445,246 B1 * 11/2008 Wagschal ..... B42F 9/001 24/67 R
8,006,354 B2 * 8/2011 Cheng ..... B42F 9/001 24/67.11
2005/0244213 A1 * 11/2005 Carmen ..... B42F 1/00 402/19
2008/0196211 A1 * 8/2008 Cheng ..... B42F 9/001 24/67.7

* cited by examiner

PLASTIC PLATE CLIP

FIELD OF THE INVENTION

The present invention relates to the technical field of office supplies, in particular to a plastic plate clip.

BACKGROUND OF THE INVENTION

As tools for storing, protecting and regularly managing paper files, file holders are essential office supplies used in enterprises, government agencies, schools and the like for sorting, binding and storing paper files. File holders may be used for containing various kinds of paper files.

Plate clips are one kind of file holders. As shown in FIG. 8 and FIG. 9, an existing plate clip includes a bottom plate 1, a hook 2 and a torsional spring 3. An end of the front side of the bottom plate 1 extends forward and curls to form a roll 12 having an axial hole. The hook 2 includes rotating shafts 21 provided on two sides of the front end, connecting portions 22 provided on two sides at the middle part, and a fixed portion 23 provided on the rear end, the two ends of each of the connecting portions 22 being connected to one end of the respective rotating shaft 21 and one end of the fixed portion 23, respectively, the other end of the rotating shaft 21 being inserted into the axial hole. The torsional spring 3 is sleeved onto to the rotating shaft 21, and one end of the torsional spring is riveted to the rotating shaft 21 while the other end of the torsional spring 3 protrudes from a slit of the roll 12 to the bottom of the bottom plate 1. The specific assembly process includes the following steps:

a first step of assembly the torsional spring 3: the torsional spring 3 is sleeved onto the rotating shaft 21 and one end of the torsional spring 3 is riveted to the rotating shaft 21; a second step of pre-tightening: the torsional spring 3 is pre-tightened; a third step of placing the torsional spring 3 and the rotating shaft 21 into the axial hole: the rotating shaft 21 and the torsional spring 3 are placed into the uncurled axial hole (at this moment, the axial hole is a semi-circular arc-shaped groove), and the other end of the torsional spring 3 is placed on the bottom of the bottom plate; a fourth step of binding: the end of the front side of the bottom plate is semi-circularly curled to form the roll 12 (at this moment, the torsional spring 3 is fixed within the axial hole of the roll 12).

A plate clip of such a structure is complex in structure, complicated in production procedures, and both manpower and material resources consuming; and the demands of dedicated tools by the pre-tightening and binding procedures lead to complex assembly and high cost. In addition, the existing plate clips can not be disassembled, such that the whole plate clip will be discarded if one of the parts is damaged. It is disadvantageous to recycling of resources as those parts can not be reused.

SUMMARY OF THE INVENTION

An object of the present invention is to, in view of the deficiencies of the prior art, provide a plastic plate clip which is simple in structure, convenient in assembly and disassembly and low in cost.

A plastic plate clip is provided, including a bottom plate, a hook and a torsional spring, the hook including rotating shafts provided on two sides of the front end, connecting portions provided on two sides of the middle part, and a fixed portion provided at the rear end, the two ends of each of the connecting portions being connected to an end of the respective rotating shaft and one end of the fixed portion, respectively, where the bottom plate is a plastic plate, and the front end of the plastic plate arches upward to form an arc-shaped groove into which the other end of the rotating shaft is inserted; the torsional spring is sleeved onto the rotating shaft, and one end of the torsional spring is riveted to the rotating shaft while the other end thereof detachably presses against the bottom plate; and the hook is hinged to the bottom plate through the rotating shaft.

A pressing groove against which the other end of the torsional spring presses is formed within the arc-shaped groove of the bottom plate.

The other end of the torsional spring presses against a side wall of the arc-shaped groove.

A pre-tightening groove facilitating the pre-tightening of the torsional spring is provided on the bottom plate.

A mounting groove for assembling the other end of the torsional spring is formed on the bottom of the bottom plate, with a baffle for stopping and preventing the torsional spring from falling off the mounting groove being provided at the upper end of the mounting groove; and when in assembly, the other end of the torsional spring is forced to be snapped into the mounting groove below the baffle.

A hanger for hanging the plastic plate clip is assembled on the bottom of the bottom plate.

A hanger groove is formed on the bottom of the bottom plate, a hanger hole is formed at the upper part of the hanger and a stopper for limiting the hanger in the hanger groove is provided at the upper part of the hanger, and the hanger is movably assembled within the hanger groove.

A bugle and a neck engaged to each other are provided on the hanger groove and the stopper, respectively; when in use of the hanger, the hanger is pulled such that the neck of the stopper disengages from the bugle and the hanger hole at the upper part of the hanger protrudes from the bottom plate; and when not in use of the hanger, the hanger is pushed such that the neck of the stopper and the bulge of the hanger groove engage to each other and the hanger is fixed within the hanger groove.

Fastening holes for fastening the plastic plate clip are formed on the bottom plate.

There are two fastening holes.

The present invention has the following beneficial effects: during assembly of the plastic plate clip, the spring is pressed into the arc-shaped groove to automatically implement pre-tightening of the spring, such that the assembly of the plastic plate clip omits the steps of pre-tightening and binding, saves both manpower and material resources, and reduces the cost; meanwhile, as the bottom plate of the plastic plate clip is a plastic plate, the surface thereof becomes more smooth, without scratching files; and such a plastic plate clip is simple in structure, convenient in assembly and disassembly and low in cost.

DETAILED DESCRIPTION OF THE PREFERRED EMBODIMENTS

In order to make those skilled in the art understand the present invention better, the present invention will be further described with reference to the accompanying drawings by specific embodiments.

Embodiment 1

Figure 1:
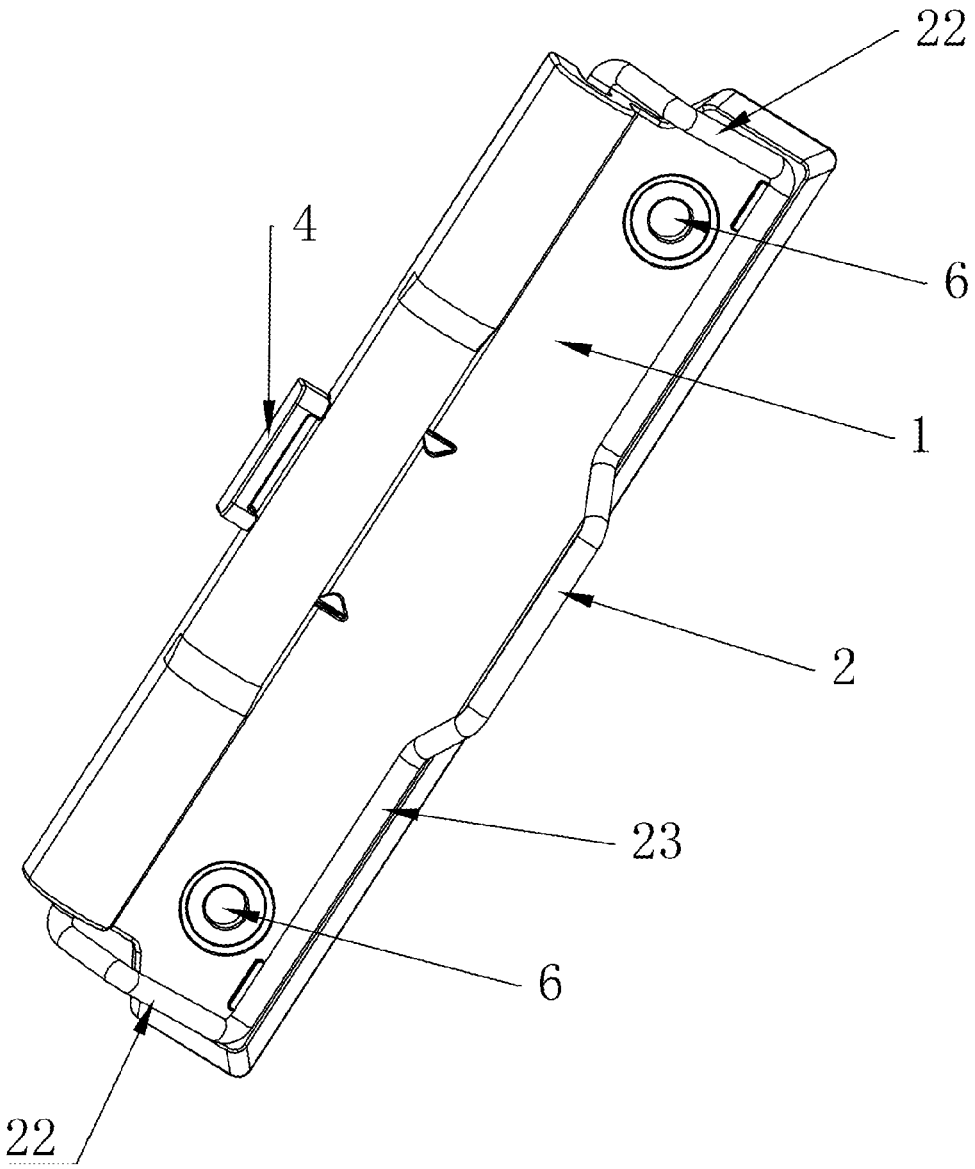
FIG. 1 is a front-side structure diagram of a plastic plate clip according to the present invention.
Figure 2:
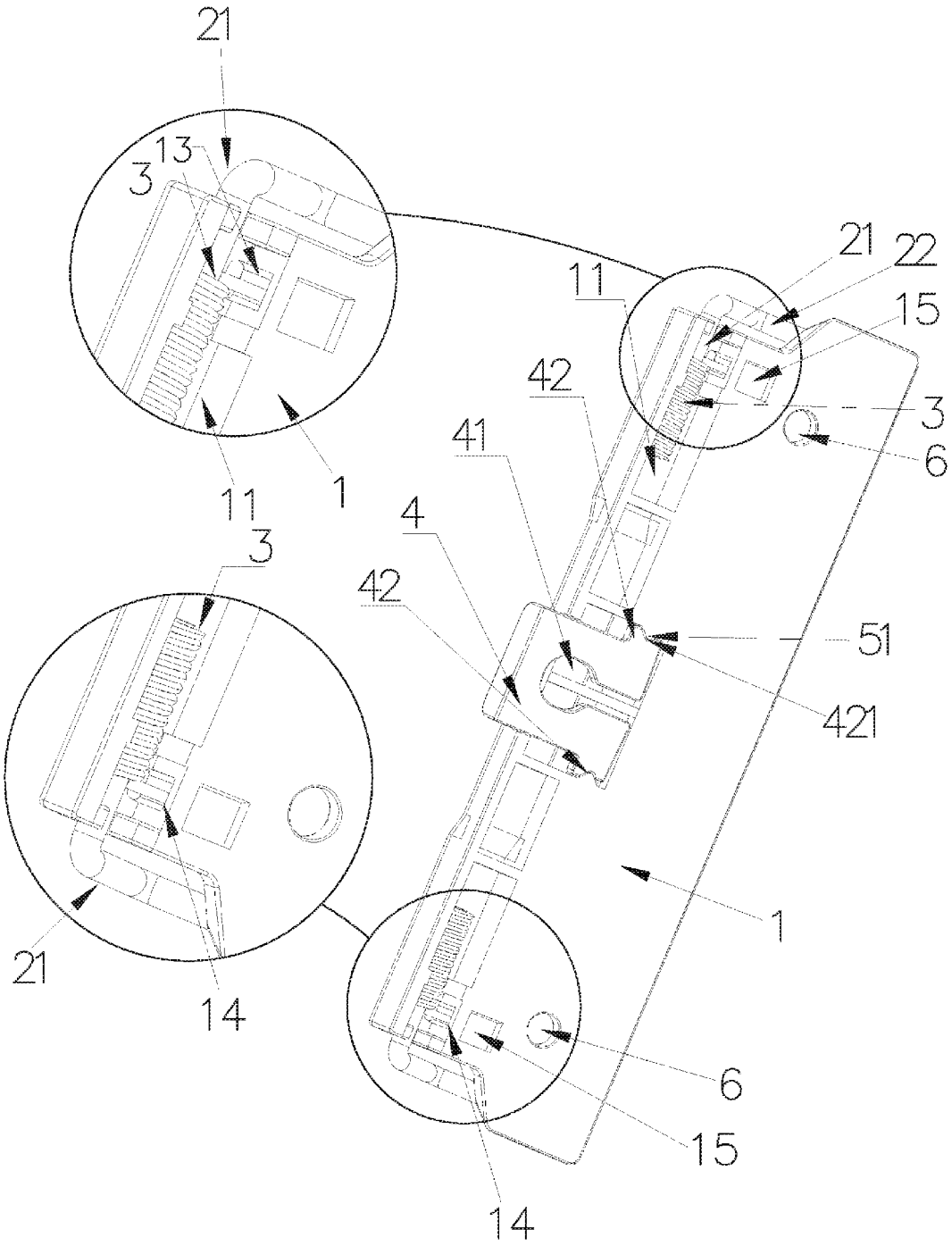
FIG. 2 is a rear-side structure diagram of Embodiment 1.
Figure 3:
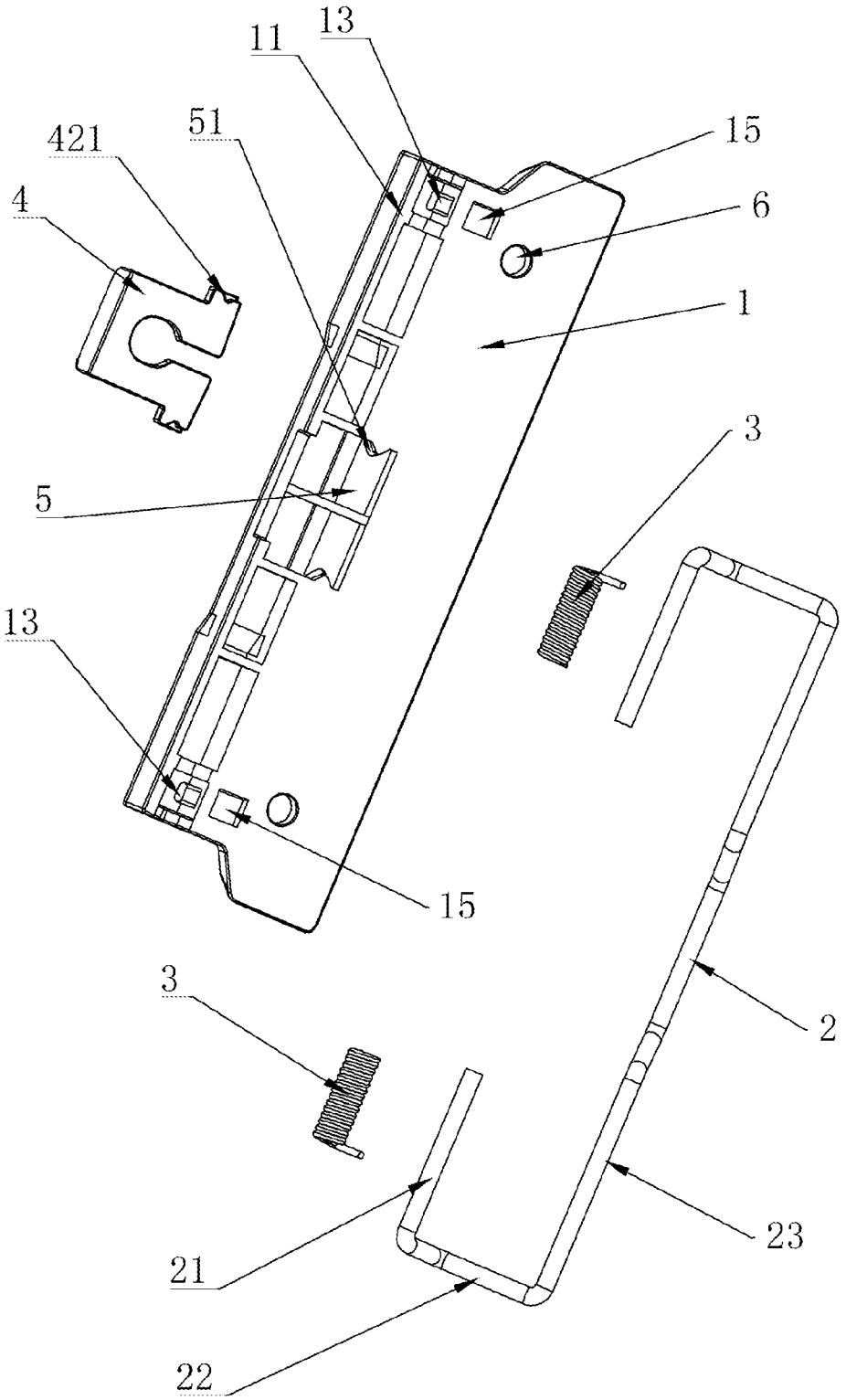
FIG. 3 is a breakdown structure diagram of FIG. 2.

As shown in FIGS. 1-3, a plastic plate clip is provided, including a bottom plate 1, a hook 2 and a torsional spring 3, the hook 2 including rotating shafts 21 provided on two sides of the front end, connecting portions 22 provided on two sides of the middle part, and a fixed portion 23 provided at the rear end, the two ends of each of the connecting portions 22 being connected to an end of the respective rotating shaft 21 and one end of the fixed portion, respectively, where the bottom plate 1 is a plastic plate, and the front end of the plastic plate arches upward to form an arc-shaped groove 11 into which the other end of the rotating shaft 21 is inserted; the torsional spring 3 is sleeved onto the rotating shaft 21, and one end of the torsional spring 3 is riveted to the rotating shaft 21 while the other end of the torsional spring 3 detachably presses against the bottom plate 1; and the hook 2 is hinged to the bottom plate 1 through the rotating shaft 21.

Pressing the other end of the torsional spring 3 against the bottom plate 1, on one hand, provides the hook 2*a* with a torque required for supporting files, and on the other hand, fastens and prevents the rotating shaft 21 from falling off the arc-shaped groove 2. The bottom plate 1 of the plastic plate clip is a plastic plate and the rotating shaft 21 is disposed within the arc-shaped groove 11. Due to the toughness of the plastic plate, one end of the torsional spring 3 detachably presses against the bottom plate 1, such that the step of binding is omitted in comparison to the existing metal plate clips and the cost is reduced. In addition, the plastic bottom plate 1 is free of sharp corners of a metal bottom plate, and thus feels smoother than a metal plate clip.

A pressing groove 13, against which the other end of the torsional spring 3 presses, is formed within the arc-shaped groove 11 of the bottom plate 1. The pressing groove 13 effectively prevents the other end of the torsional spring 3 from falling off the arc-shaped groove 11, thereby achieving a purpose of fastening.

A pre-tightening groove 15 facilitating the pre-tightening of the torsional spring 3 is provided on the bottom plate 1.

The specific assembly process includes the following steps:

a first step of assembly the torsional spring 3: the torsional spring 3 is sleeved onto the rotating shaft 21 and one end of the torsional spring 3 is riveted to the rotating shaft 21;

a second step: the fixed portion 23 of the hook 2 is placed on the front side of the bottom plate 1, the rotating shaft 21 of the hook 2 is placed at the opening of the arc-shaped groove 11 on the rear side, and the other end of the torsional spring 3 is disposed in the pre-tightening groove 15 of the bottom plate 1; and a third step: the rotating shaft 21 of the hook 2 is pressed into the arc-shaped groove 11, and the other end of the torsional spring 3 is forced to fall into the pressing groove 13 within the arc-shaped groove 11 (at this moment, the torsional spring 3 is fixed within the arc-shaped groove 11).

Due to the elasticity of the torsional spring 3, the procedure of automatic pre-tightening of the torsional spring 3 is implemented during the pressing of the hook 2.

When in disassembly, the other end of the torsional spring 3 is moved away from the pressing groove 13 by a tool, such that the torsional spring 3 falls off the arc-shaped groove 11 and the bottom plate 1 is disengaged from the hook 2. Now, the disassembly process ends.

A hanger 4 for hanging the plastic plate clip is assembled on the bottom of the bottom plate 1. The hanger 4 is advantageous to hang the plastic plate clip and convenient in use.

A hanger groove 5 is formed on the bottom of the bottom plate 1, a hanger hole 41 is formed at the upper part of the hanger 4 and a stopper 42 for limiting the hanger 4 in the hanger groove 5 is provided at the upper part of the hanger 4, and the hanger 4 is movably assembled within the hanger groove 5.

A bugle 51 and a neck 421 engaged to each other are provided on the hanger groove 5 and the stopper 42, respectively; when in use of the hanger 4, the hanger 4 is pulled such that the neck 421 of the stopper 42 disengages from the bugle 51 and the hanger hole 41 at the upper part of the hanger 4 protrudes from the bottom plate 1; and when not in use of the hanger 4, the hanger 4 is pushed such that the neck 421 of the stopper 42 and the bulge 51 of the hanger groove 5 engage to each other and the hanger 4 is fixed within the hanger groove 5.

Fastening holes 6 for fastening the plastic plate clip are formed on the bottom plate 1.

Further, there are two fastening holes 6. Generally, the plastic plate clip may be fastened on a fixed plate for use, and this may be accomplished by the fastening holes 6. Considering firmness and convenience of assembly or other factors, it is the most practical to design two fastening holes 6.

Embodiment 2

Figure 4:
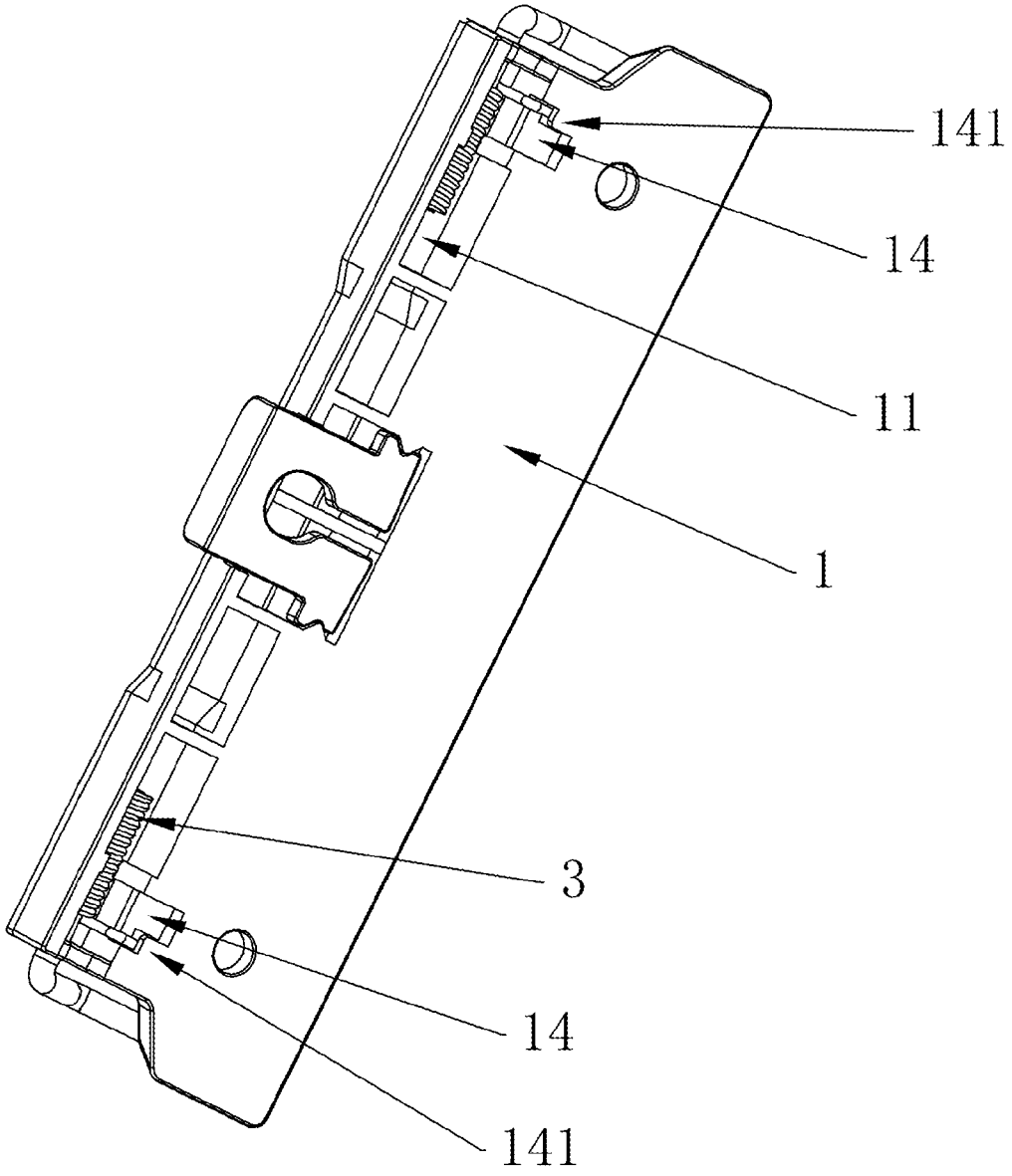
FIG. 4 is a rear-side structure diagram of Embodiment 2.
Figure 5:
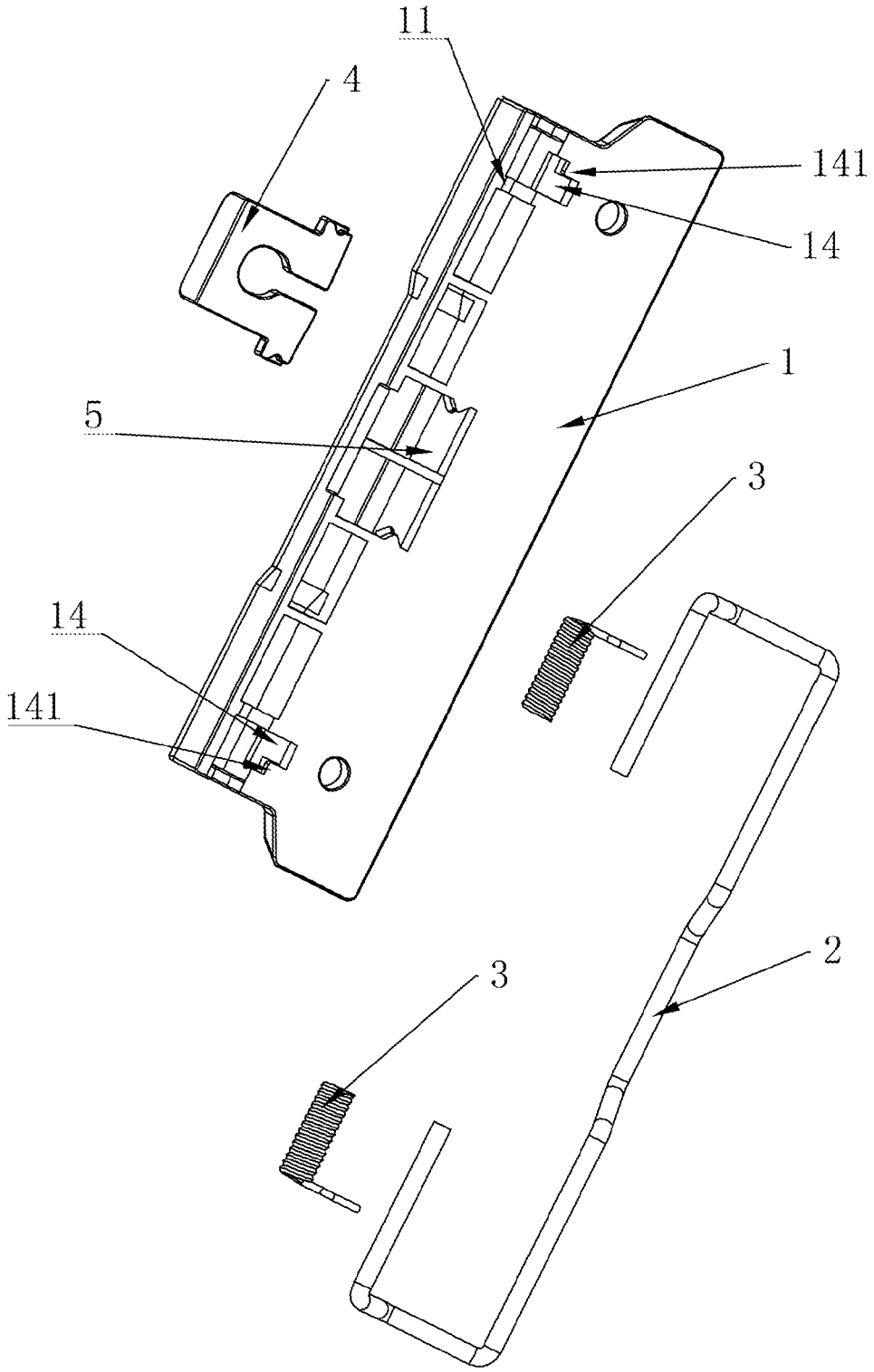
FIG. 5 is a breakdown structure diagram of FIG. 4.

As shown in FIG. 4 and FIG. 5, this embodiment differs from Embodiment 1 in that a mounting groove 14 for assembling the other end of the torsional spring 3 is formed on the bottom of the bottom plate 1, with a baffle 141 for stopping and preventing the torsional spring 3 from falling off the mounting groove 14 being provided at the upper end of the mounting groove 14; and when in assembly, the other end of the torsional spring 3 is forced to be snapped into the mounting groove 14 below the baffle 141.

With the bottom plate 1 of this solution, it is possible to effectively prevent the torsional spring 3 from falling off, and both the assembly and disassembly are quite convenient.

The specific assembly process includes the following steps:

a first step of assembly the torsional spring 3: the torsional spring 3 is sleeved onto the rotating shaft 21 and one end of the torsional spring 3 is riveted to the rotating shaft 21;

a second step: the fixed portion 23 of the hook 2 is placed on the front side of the bottom plate 1, the rotating shaft 21 of the hook 2 is placed at the opening of the arc-shaped groove 11 on the rear side, and the other end of the torsional spring 3 is disposed on the mounting groove 14;

a third step: the rotating shaft 21 of the hook is pressed into the arc-shaped groove 11; and a fourth step: the other end of the torsional spring 3 is forced to be snapped into the mounting groove 14 below the baffle 141 (at this moment, the torsional spring 3 is fixed within the arc-shaped groove 11).

When in disassembly, the other end of the torsional spring 3 is moved away from the baffle 141 by a tool and taken out from the mounting groove 14. At this moment, the torsional spring 3 falls off the arc-shaped groove 11 and the bottom plate 1 is disengaged from the hook 2. Now, the disassembly process ends.

Embodiment 3

Figure 6:
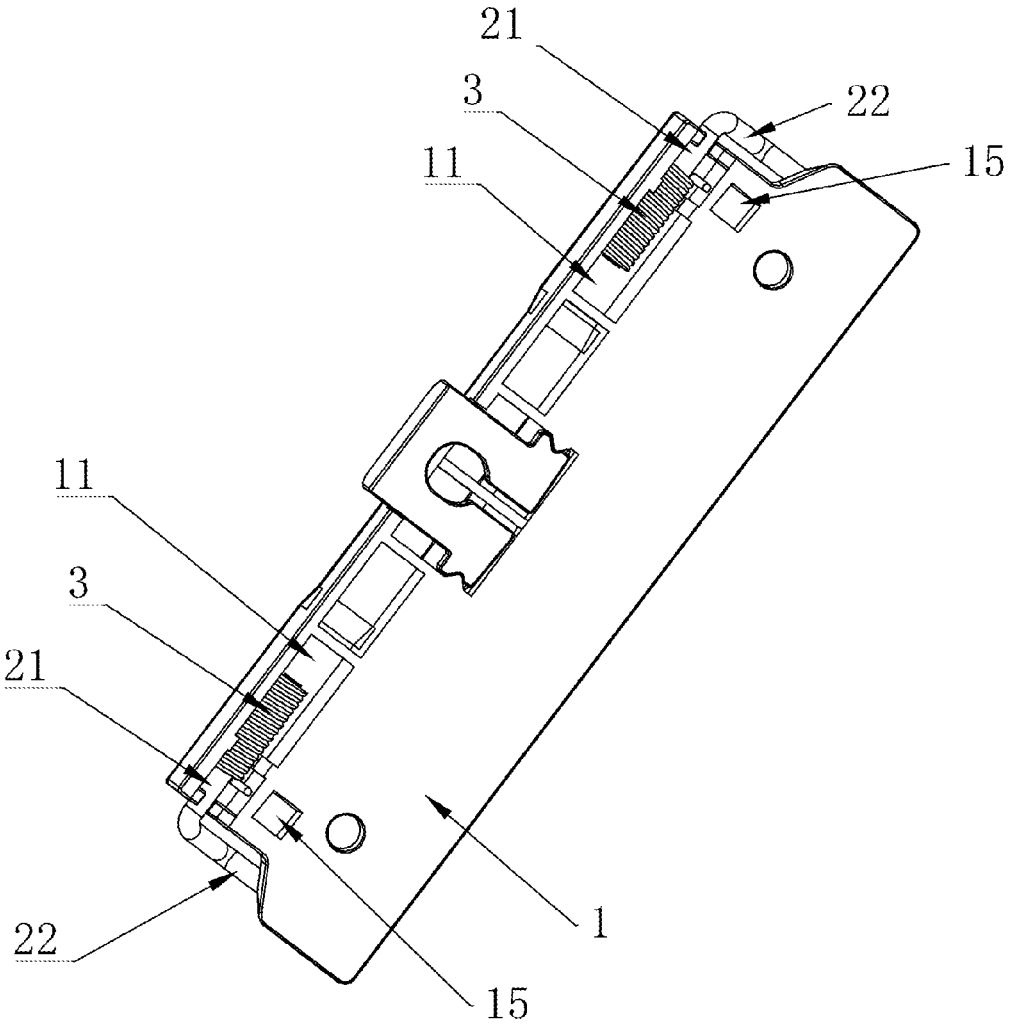
FIG. 6 is a rear-side structure diagram of Embodiment 3.
Figure 7:
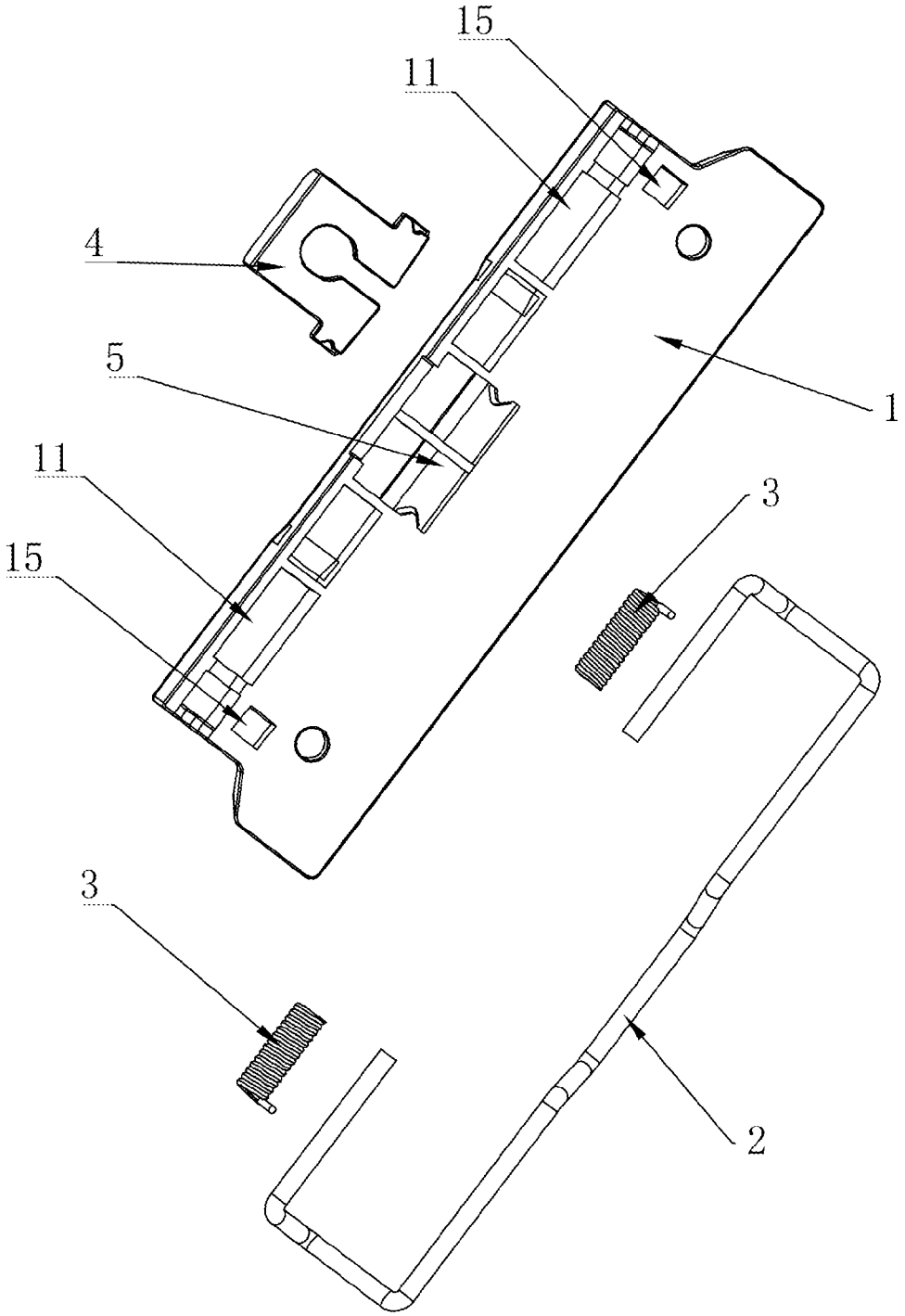
FIG. 7 is a breakdown structure diagram of FIG. 6.
Figure 8:
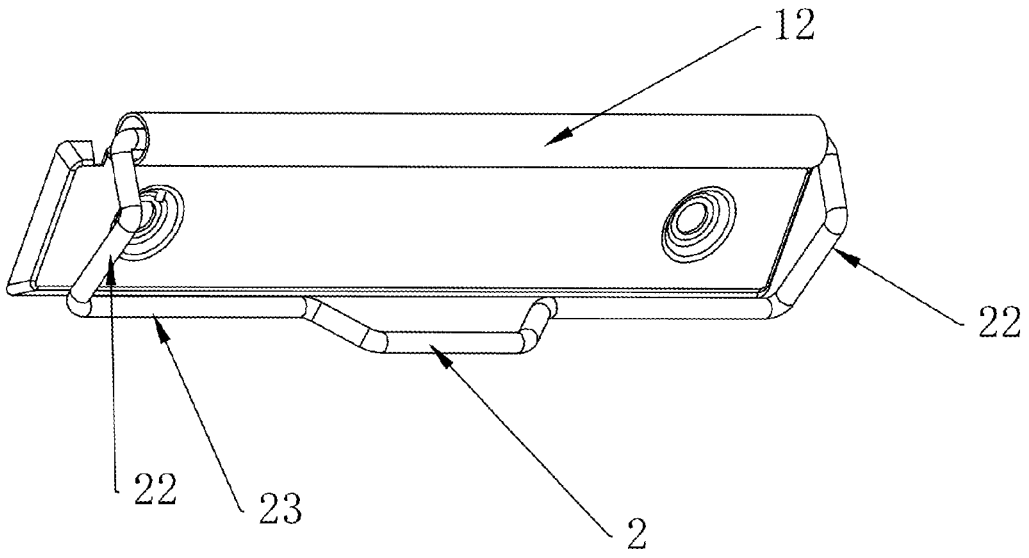
Fig. 8 (Prior Art)
FIG. 8 is a front-side structure diagram of a plastic plate clip according to the prior art.
Figure 9:
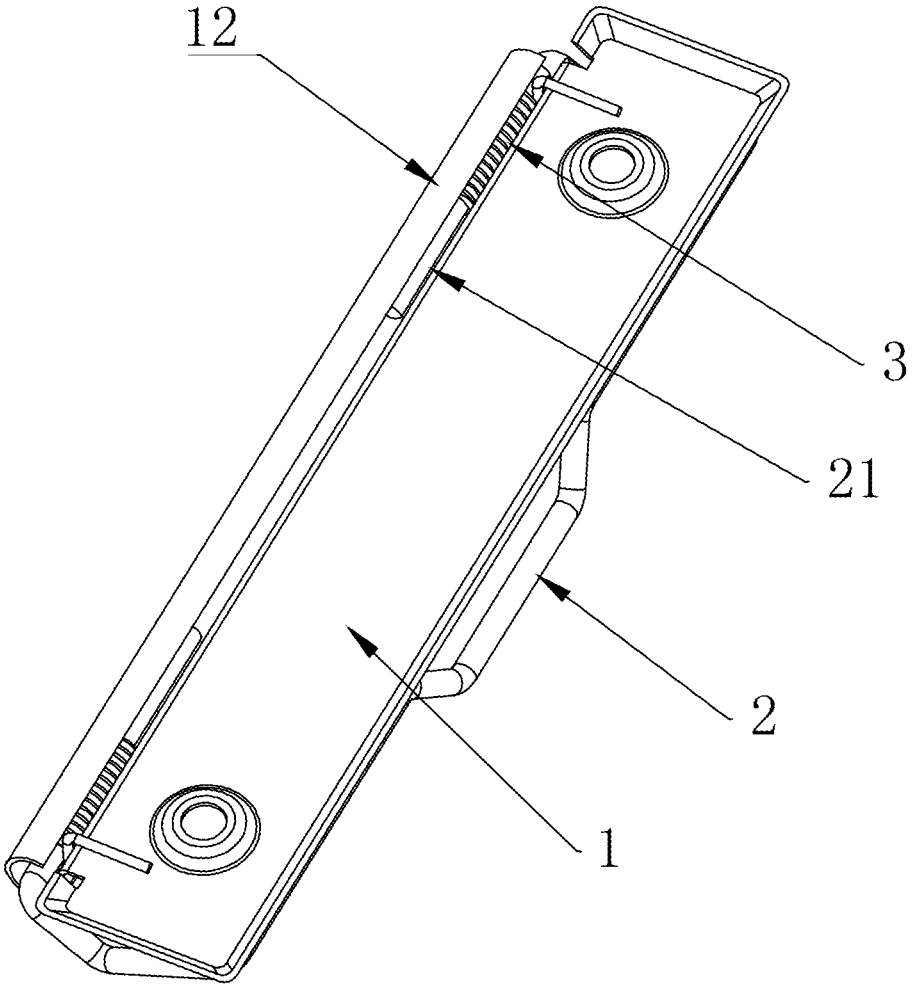
Fig. 9 (Prior Art)
FIG. 9 is a rear-side structure diagram of the plastic plate clip according to the prior art.

As shown in FIG. 6 and FIG. 7, this embodiment differs from Embodiment 1 and Embodiment 2 in that the other end of the torsional spring 3 presses against a side wall of the arc-shaped groove 11. A pre-tightening groove 15 facilitating the pre-tightening of the torsional spring 3 is provided on the bottom plate 1.

The specific assembly process includes the following steps:

a first step of assembly the torsional spring 3: the torsional spring 3 is sleeved onto the rotating shaft 21 and one end of the torsional spring 3 is riveted to the rotating shaft 21;

a second step: the fixed portion 23 of the hook 2 is placed on the front side of the bottom plate 1, the rotating shaft 21 of the hook 2 is placed at the opening of the arc-shaped groove 11 on the rear side, and the other end of the torsional spring 3 is disposed in the pre-tightening groove 15 of the bottom plate 1; and a third step: the rotating shaft 21 of the hook 2 is pressed into the arc-shaped groove 11, and the other end of the torsional spring 3 is forced to fall into the arc-shaped groove 11 and press against the side wall of the arc-shaped groove 11. As the bottom plate 1 is made of plastic, the other end of the torsional spring 3 may be ensured to be clamped with the side wall due to the toughness of plastic. Due to the elasticity of the torsional spring 3, the procedure of automatic pre-tightening of the torsional spring 3 is implemented during the pressing of the hook 2.

When in disassembly, the other end of the torsional spring 3 is moved away from the arc-shaped groove 11 by a tool, such that the torsional spring 3 falls off the arc-shaped groove 11 and the bottom plate 1 is disengaged from the hook 2. Now, the disassembly process ends.

The bottom plate 1 of such a structure is simple in structure and easy in production. However, there is a risk that the torsional spring 3 may fall off the arc-shaped groove 11. Therefore, generally, a plastic plate clip of such a structure is directly fastened on a fixed plate for use. This may effectively prevent the torsional spring 3 from falling off and makes the use quite convenient. In this embodiment, a pressing block may be further provided within the arc-shaped groove 11 for fastening the other end of the torsional spring.

The foregoing embodiments are provided just for illustrating the technical solutions of the present invention, and not intended to limit the protect scope of the present invention. Although the present invention has been described in details with reference to preferred embodiments, it should be understood by those skilled in the art that modifications or equivalent replacements may be made to the technical solutions of the present invention without departing from the spirit and scope of the technical solutions of the present invention.

The invention claimed is:

1. A plastic plate clip comprising:
a bottom plate;
a hook;
two torsional springs;
the hook comprising two rotating shafts, two connecting portions and a fixed portion;
the two rotating shafts being disposed on two sides of a front end of the bottom plate, respectively;
the two connecting portions being disposed on two sides of a middle part of the bottom plate, respectively;
the fixed portion being disposed at a rear end of the bottom plate;
the fixed portion being connected in between the two connecting portions;
the two connecting portions being disposed in between the two rotating shafts;
the connecting portion being connected in between the rotating shaft and the fixed portion;
the bottom plate being made of plastic materials;
the front end of the bottom plate arching upward to form two arc-shaped grooves;
the two rotating shafts being inserted within the two arc-shaped grooves, respectively;
the two torsional springs being sleeved onto the two rotating shafts, respectively;
one end of the torsional spring being riveted to the rotating shaft;
the other end of the torsional spring detachably pressing against the bottom plate;
the hook being hinged to the bottom plate through the two rotating shafts;
two pressing grooves;
the two pressing grooves being formed within the two arc-shaped groove, respectively;
the two torsional springs pressing against the two pressing grooves, respectively;
two mounting grooves;
the two mounting grooves being formed on a bottom of the bottom plate;
the two mounting grooves being for assembling the two torsional springs, respectively;
the mounting groove comprising a baffle formed on an upper end thereof;
the baffle being for stopping and preventing the torsional spring from falling off the mounting groove; and
the torsional spring being forced to be snapped into the mounting groove below the baffle.

2. The plastic plate clip according to claim 1 comprising:
the torsional spring pressing against a side wall of the arc-shaped groove.

3. The plastic plate clip according to claim 1 comprising:
a pre-tightening groove;
the pre-tightening groove facilitating the pre-tightening of the torsional spring; and
the pre-tightening groove being formed on the bottom plate.

4. The plastic plate clip according to claim 1 comprising:
a hanger;
the hanger being for hanging the plastic plate clip; and
the hanger being assembled on the bottom of the bottom plate.

5. The plastic plate clip according to claim 4 comprising:
a hanger groove;
the hanger groove being formed on the bottom of the bottom plate;
a hanger hole;
the hanger hole being formed at an upper part of the hanger;
a stopper;
the stopper being for limiting the hanger in the hanger groove;

the stopper being formed at the upper part of the hanger; and the hanger being movably assembled within the hanger groove.

6. The plastic plate clip according to claim 5 comprising:

the hanger groove comprising a bulge;

the stopper comprising a neck;

the bulge and the neck being engaged to each other;

the neck of the stopper disengaging from the bulge and the hanger hole at the upper part of the hanger protruding from the bottom plate in response to the hanger being pulled; and the neck of the stopper and the bulge of the hanger groove engaging to each other and the hanger being fixed within the hanger groove in response to the hanger being pushed.

7. The plastic plate clip according to claim 1 comprising:

a fastening hole; and the fastening hole being formed on the bottom plate.

8. The plastic plate clip according to claim 7 comprising:

another fastening hole; and the another fastening hole being formed on the bottom plate.

* * * * *